US009212017B2

(12) United States Patent
Furusawa

(10) Patent No.: US 9,212,017 B2
(45) Date of Patent: Dec. 15, 2015

(54) MEDIUM DISCHARGE DEVICE AND IMAGE FORMING APPARATUS

(71) Applicant: Oki Data Corporation, Tokyo (JP)

(72) Inventor: Yasunori Furusawa, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/314,772

(22) Filed: Jun. 25, 2014

(65) Prior Publication Data

US 2015/0001795 A1 Jan. 1, 2015

(30) Foreign Application Priority Data

Jun. 26, 2013 (JP) ..... 2013-133707

(51) Int. Cl.

| | |
|---|---|
| ***B65H 29/70*** | (2006.01) |
| ***B65H 29/52*** | (2006.01) |
| ***B65H 29/12*** | (2006.01) |
| ***G03G 15/00*** | (2006.01) |

(52) U.S. Cl.

CPC ..... *B65H 29/125* (2013.01); *B65H 29/52* (2013.01); *B65H 29/70* (2013.01); *G03G 15/6552* (2013.01)

(58) Field of Classification Search

CPC ..... B65H 29/70; B65H 29/52
USPC ..... 271/188, 209
See application file for complete search history.

(56) References Cited

U.S. PATENT DOCUMENTS

| | | | | |
|---|---|---|---|---|
| 5,194,904 | A * | 3/1993 | Ruch | 399/397 |
| 6,190,070 | B1 | 2/2001 | Urban et al. | |
| 8,523,175 | B2 * | 9/2013 | Kobayashi et al. | 271/188 |
| 2005/0220520 | A1 | 10/2005 | Kawamoto | |
| 2014/0353901 | A1 * | 12/2014 | Aoyama | 271/3.19 |

FOREIGN PATENT DOCUMENTS

| | | | |
|---|---|---|---|
| JP | 2006335510 | A * | 12/2006 |
| JP | 2007331845 | A * | 12/2007 |
| JP | 2010-006537 | A | 1/2010 |
| JP | 2011-173720 | A | 9/2011 |
| JP | 2011-184178 | A | 9/2011 |
| JP | 2012-093648 | A | 5/2012 |

* cited by examiner

*Primary Examiner* — Luis A Gonzalez
(74) *Attorney, Agent, or Firm* — Rabin & Berdo, P.C.

(57) ABSTRACT

A medium discharge device includes: a discharge tray having a placing surface on which a medium is to be placed; a first pair of discharge rollers configured to rotate about axes to discharge the medium through a first nip onto the discharge tray; a second pair of discharge rollers configured to rotate about the axes to discharge the medium through a second nip onto the discharge tray; and a discharge guide for guiding the discharged medium. The discharge guide includes a first projection between the first and second pairs of discharge rollers, and a second projection on an opposite side of the first projection with respect to the first pair of discharge rollers. Each of the first and second projections projects to the placing surface side relative to the first and second nips and has a guide surface opposite to the placing surface.

21 Claims, 8 Drawing Sheets

MEDIUM DISCHARGE DEVICE AND IMAGE FORMING APPARATUS

BACKGROUND OF THE INVENTION

1. Field of the Invention

The present invention relates to a medium discharge device for discharging a medium, such as a recording medium after printing, outside an apparatus, and an image forming apparatus including the medium discharge device.

2. Description of the Related Art

A general image forming apparatus, such as a copier, a facsimile machine, and a scanner, includes a conveying path on which recording media are conveyed, discharge rollers for discharging the recording media outside the image forming apparatus, and a stacker on which the discharged recording media are stacked (for example, see Japanese Patent Application Publication No. 2012-93648).

As the number of recording media stackable on the stacker increases, the distance from the discharge rollers to the stacker increases, and the possibility of improper stacking due to sagging of the leading edge of the recording medium during discharge increases.

SUMMARY OF THE INVENTION

An aspect of the present invention is intended to reduce the occurrence of improper-discharge of a medium.

According to an aspect of the present invention, there is provided a medium discharge device including: a discharge tray having a placing surface on which a medium is to be placed; a first pair of discharge rollers configured to form a first nip between the first pair of discharge rollers, and rotate about respective axes parallel to each other to discharge the medium through the first nip in a discharging direction onto the discharge tray; a second pair of discharge rollers configured to form a second nip between the second pair of discharge rollers, and rotate about the respective axes to discharge the medium through the second nip in the discharging direction onto the discharge tray; and a discharge guide for guiding the medium discharged by the first pair of discharge rollers and the second pair of discharge rollers. The discharge guide includes: a first projection disposed between the first pair of discharge rollers and the second pair of discharge rollers in an axial direction parallel to the axes, the first projection projecting to the placing surface side relative to the first and second nips and having a first guide surface opposite to the placing surface; and a second projection disposed on an opposite side of the first projection with respect to the first pair of discharge rollers in the axial direction, the second projection projecting to the placing surface side relative to the first and second nips and having a second guide surface opposite to the placing surface.

According to an another aspect of the present invention there is provided an image forming apparatus including the above described medium discharge device.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Embodiments of the invention will now be described with reference to the attached drawings.

First Embodiment

Figure 1:
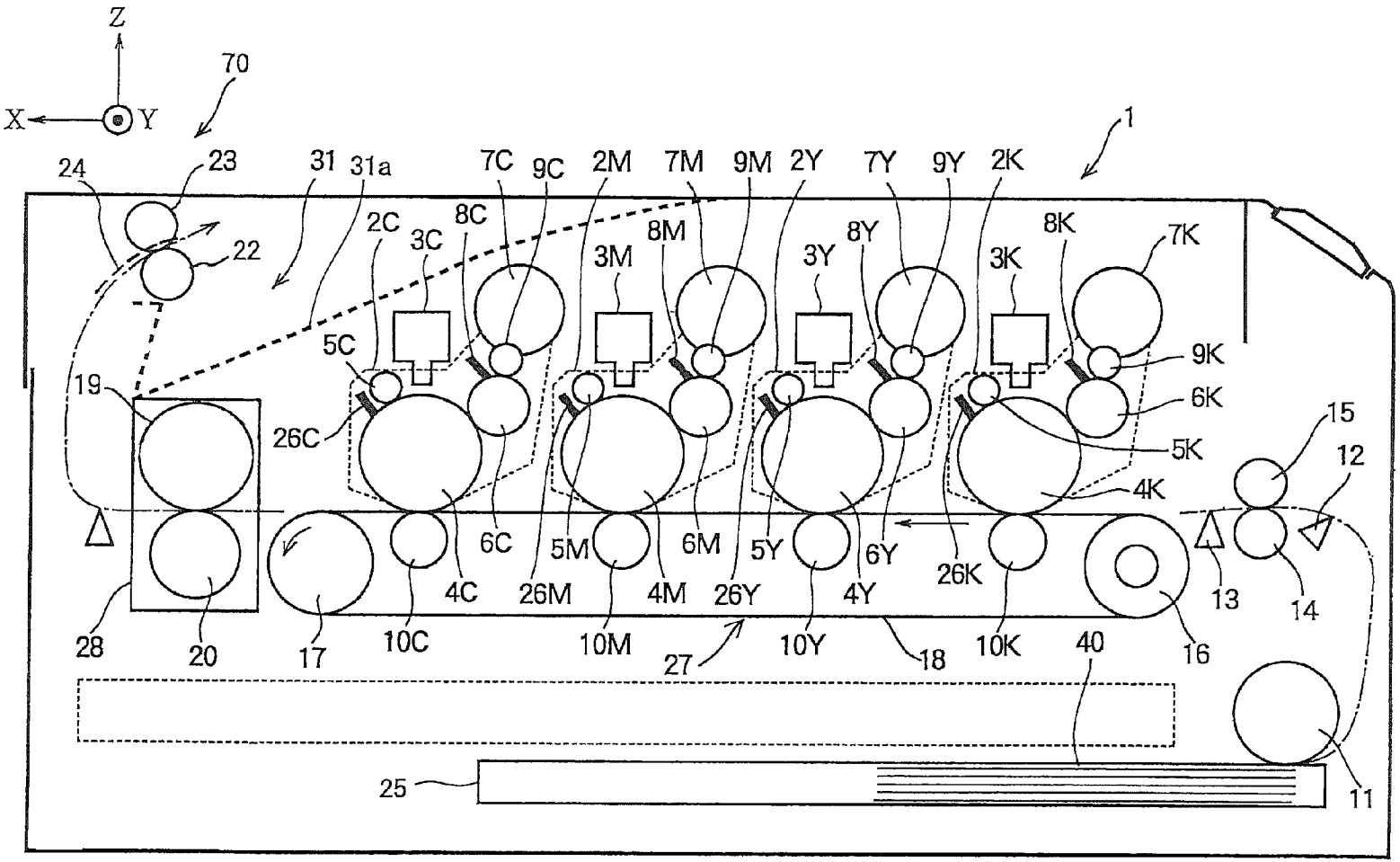
FIG. 1 is a schematic view showing a configuration of an image forming apparatus including a medium discharge device in a first embodiment of the invention.

FIG. 1 is a schematic view showing a configuration of an image forming apparatus 1 including a medium discharge device in the first embodiment.

As shown in FIG. 1, the image forming apparatus 1 includes four image forming units 2K, 2Y, 2M, and 2C, a transfer unit 27, a sheet cassette 25, a sheet feeding roller 11, an entrance sensor 12, a writing sensor 13, conveying rollers 14 and 15, a fixing unit 28, and a medium discharge device 70.

The image forming units 2K, 2Y, 2M, and 2C form toner images of black (K), yellow (Y), magenta (M), and cyan (C), respectively. So, the image forming units 2K, 2Y, 2M, and 2C include LED heads 3K, 3Y, 3M, and 3C, photosensitive drums 4K, 4Y, 4M, and 4C, charging-rollers 5K, 5Y, 5M, and 5C, developing rollers 6K, 6Y, 6M, and 6C, toner tanks 7K, 7Y, 7M, and 7C, developing blades 8K, 8Y, 8M, and 8C, and toner supplying sponge rollers. 9K, 9Y, 9M, and 9C, respectively.

The sheet cassette 25 stores recording sheets (e.g., sheets of paper) 40 as media. The sheet feeding roller 11 picks up and feeds the recording sheets 40 one by one from the sheet cassette 25 into a conveying path by cooperating with a separation member (not shown). The conveying rollers 14 and 15 conveys the fed recording sheet 40 to the transfer unit 27. The transfer unit 27 includes an endless conveying belt 18, a belt driven roller 16, a belt driving roller 17, and transfer rollers 10K, 10Y, 10M, and 100. The conveying belt 18 conveys the recording sheet 40 from the conveying rollers 14 and 15. The transfer rollers 10K, 10Y, 10M, and 100 transfer the toner images from the image forming unit 2K, 2Y, 2M, and 2C to the recording sheet 40 conveyed on the conveying belt 18, respectively. The fixing unit 28 applies heat and pressure to the recording sheet 40 with the toner images transferred thereon to fix the toner images to the recording sheet 40. The fixing unit 28 includes a fixing roller 19 having a heater such as a halogen lamp therein and a fixing backup roller 20. The medium discharge device 70 includes a first discharge roller 22, a second discharge roller 23, a discharge guide 24, and a discharge tray 31. The first and second discharge rollers 22 and 23 discharge the recording sheet, 40 after the fixing. The discharge guide 24 guides the recording sheet 40 discharged by the first and second discharge rollers 22 and 23. The discharge tray 31 stacks the recording sheet 40 discharged by the first and second discharge rollers 22 and 23. The discharge tray 31 has a placing surface 31*a* on which the recording sheet 40 is placed.

In the image forming apparatus 1, the recording sheet 40 is conveyed on the conveying path in a conveying direction. The image forming apparatus 1 further includes motors for rotating the rollers and other rotating members, rollers disposed on the conveying path at intervals not longer than a length of a minimum recording sheet in the conveying direction, a solenoid for switching the conveying path, or the like, which are not shown in FIG. 1. The motors includes a sheet feeding motor for mainly rotating the sheet feeding roller 11, a conveying motor for rotating the conveying rollers 14 and 15, a conveying belt motor for rotating the belt driving roller 17, a fixing motor for rotating the fixing roller 19, the fixing backup roller 20, and the discharge rollers 22 and 23, image forming motors for individually rotationally driving the image forming units 2K, 2Y, 2M, and 2C, and the like.

In FIG. 1, the X-axis represents a direction in which the recording sheet 40 is conveyed when passing through the image forming units 2K, 2Y, 2M, and 2C, the Y-axis represents a direction parallel to axes of rotation of the photosensitive drums 4K, 4Y, 4M, and 4C, and the Z-axis represents a direction perpendicular to both the X-axis and the Y-axis. The same applies to FIGS. 2 to 7. Here, the image forming apparatus 1 is set so that the Z-axis is directed in a substantially vertical direction.

Next, a configuration of the medium discharge device 70 will be described with reference to FIGS. 2 to 6.

Figure 2:
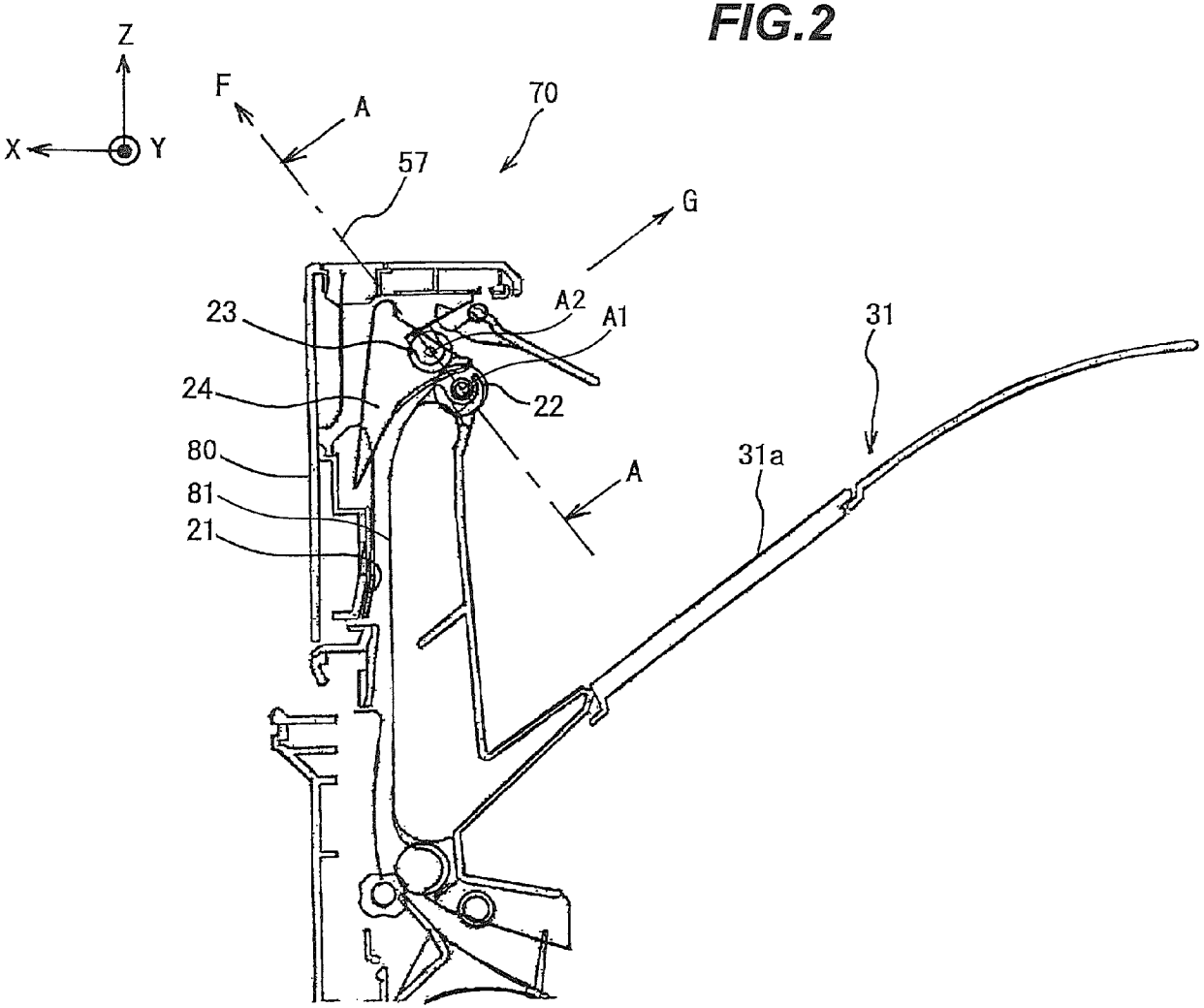
FIG. 2 is an enlarged partial sectional view showing the medium discharge device in FIG. 1.
Figure 3:
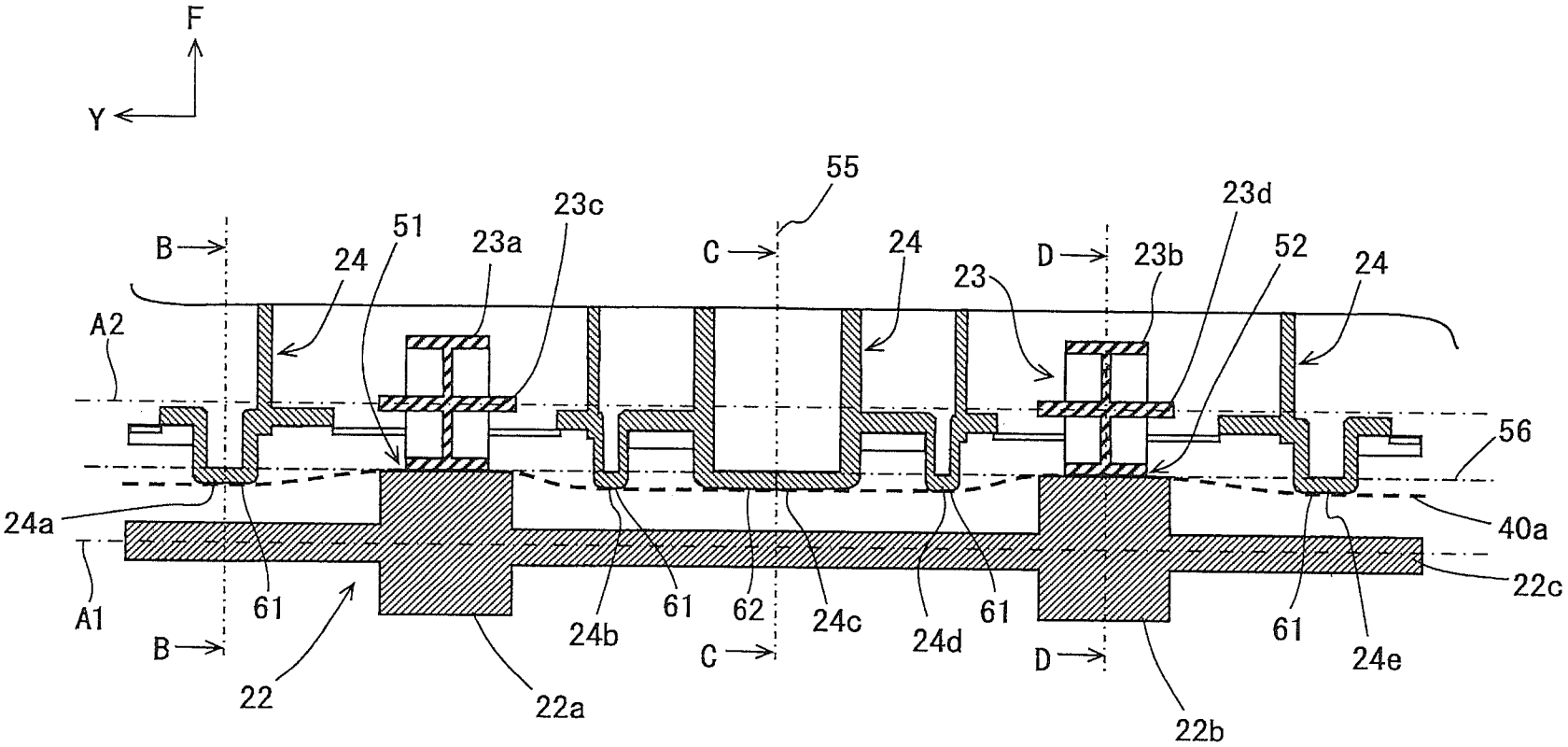
FIG. 3 is a main part sectional view along line A-A in FIG. 2.
Figure 4:
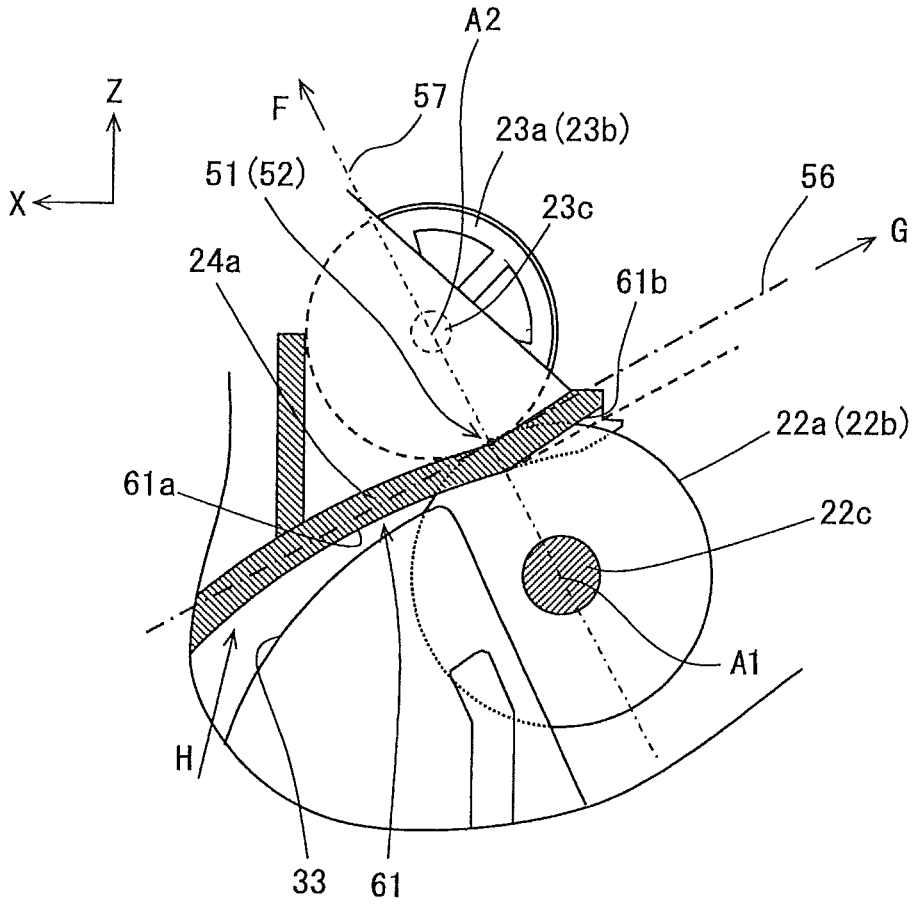
FIG. 4 is a sectional view along line B-B in FIG. 3.
Figure 5:
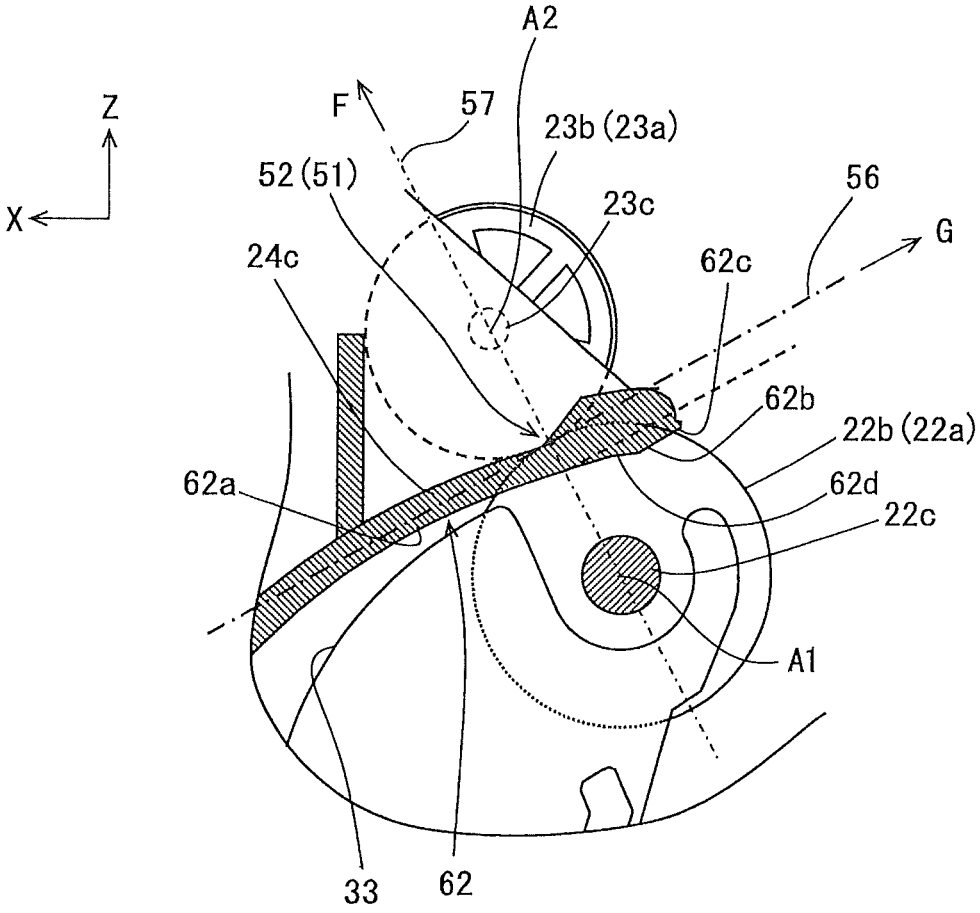
FIG. 5 is a sectional view along line C-C in FIG. 3.
Figure 6:
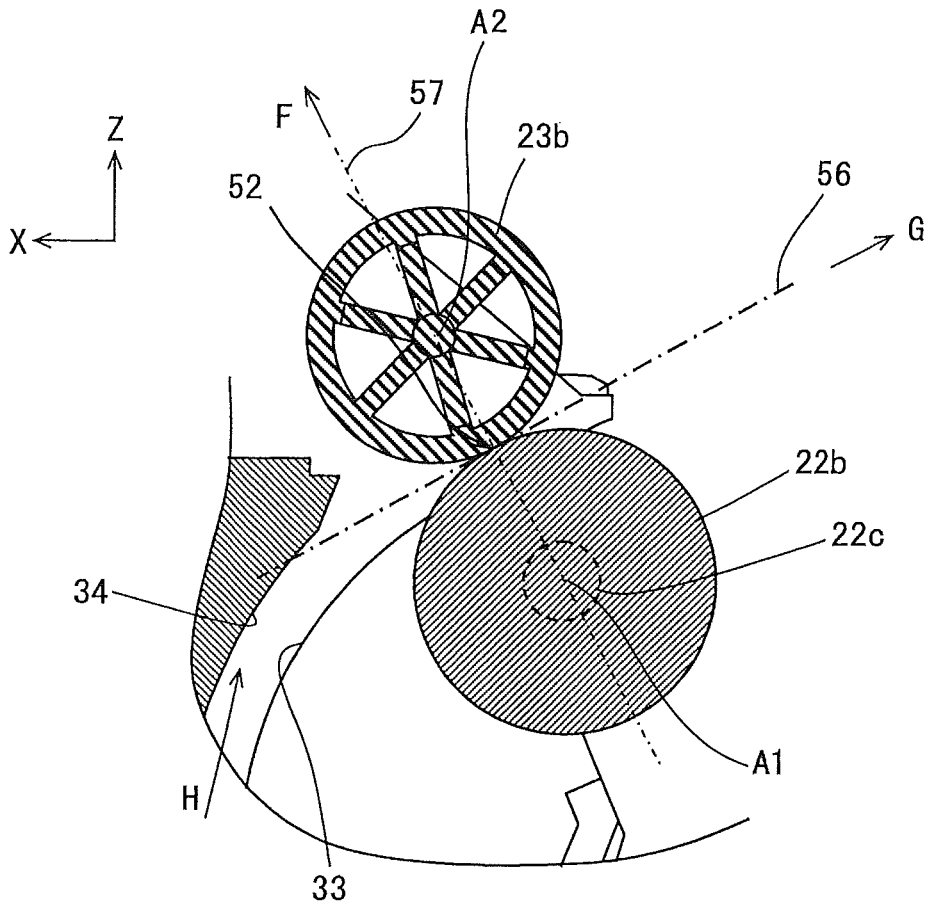
FIG. 6 is a sectional view along line D-D in FIG. 3.

FIG. 2 is an enlarged partial sectional view showing the medium discharge device 70 in FIG. 1. FIG. 3 is a main part sectional view along line A-A in FIG. 2. FIG. 4 is a sectional view along line B-B in FIG. 3. FIG. 5 is a sectional view along line C-C in FIG. 3. FIG. 6 is a sectional view along line D-D in FIG. 3.

As shown in FIG. 2, the first discharge roller 22, the second discharge roller 23, the discharge guide 24, and the discharge tray 31 are attached to a main body 80 of the image forming apparatus 1. The main body 80 has a guide portion 81 for guiding the recording sheet 40 from the fixing unit 28. The first discharge roller 22 has an axis of rotation A1 (referred to below simply as the axis A1) parallel to the Y-axis. The second discharge roller 23 has an axis of rotation A2 (referred to below simply as the axis A2) parallel to the Y-axis. As described later, the first discharge roller 22 and the second discharge roller 23 are disposed to form nips between their peripheral surfaces. The first discharge roller 22 and the second discharge roller 23 discharge the recording sheet 40 in a discharging direction (indicated by arrow G in FIG. 2), which is perpendicular to a virtual line 57 (indicated by the dashed-dotted line in FIG. 2) perpendicularly intersecting the axes A1 and A2. The discharging direction (i.e., the direction of arrow G) is directed obliquely upward. Here, the first discharge roller 22 is disposed below the second discharge roller 23 and on a discharge side (or the discharge tray 31 side) of the second discharge roller 23 in a horizontal direction.

As shown in FIG. 3, the second discharge roller 23 includes a pair of roller portions 23*a* and 23*b* having the same shape. The roller portions 23*a* and 23*b* are disposed rotatably about the axis A2 at a predetermined interval. The roller portions 23*a* and 23*b* respectively have shafts 23*c* and 23*d* on the same axis A2. The first discharge roller 22 has a shaft 22*c* parallel to the shafts 23*c* and 23*d* of the second discharge roller 23, and a pair of roller portions 22*a* and 22*b* formed on the shaft 22*c* so as to face the pair of roller portions 23*a* and 23*b* of the second discharge roller 23. The roller portions 22*a* and 22*b* have the same shape, and are slightly wider than the roller portions 23*a* and 23*b* in the Y-axis direction, respectively. The roller portions 22*a* and 23*a* form a nip 51 at a roller facing portion at which the roller portions 22*a* and 23*a* face each other. The roller portions 22*b* and 23*b* form a nip 52 at a roller facing portion at which the roller portions 22*b* and 23*b* face each other.

Here, the first discharge roller 22 receives rotational force to rotate in a direction for discharging the recording sheet 40, and the pair of roller portions 23*a* and 23*b* of the second discharge roller 23 are rotated by the rotation of the first discharge roller 22 by friction with the first discharge roller 22 either directly or via the recording sheet 40. That is, the first discharge roller 22 is a driving roller and the second discharge roller 23 is a driven roller. The roller portions 22*a* and 23*a* constitute a first pair of discharge rollers, which are configured to form a nip 51 therebetween and rotate about axes A1 and A2 to discharge the recording sheet 40 through the nip 51 onto the discharge tray 31. The roller portions 22*b* and 23*b* constitute a second pair of discharge rollers, which are configured to form a nip 52 therebetween and rotate about axes A1 and A2 to discharge the recording sheet 40 through the nip 52 onto the discharge tray 31. The first pair of discharge rollers and the second pair of discharge rollers rotate together about respective axes A1 and A2 to discharge the recording sheet 40 through the nips 51 and 52 respectively onto the discharge tray 31. The first pair of discharge rollers and the second pair of discharge rollers are at positions different from each other in the direction of the axes A1 and A2, and define a discharge plane 56 (indicated by the dashed-dotted line in FIG. 3) passing through the nips 51 and 52 and being perpendicular to the virtual line 57 extending along the direction of arrow F.

The discharge guide 24 includes a plurality of projections: a projection 24*a* as a second projection, a projection 24*b* as a fourth projection, a projection 24*c* as a first projection, a projection 24*d* as a fifth projection, and a projection 24*e* as a third projection. The projections 24*a* to 24*e* are arranged in the Y-axis direction. Each of the projections 24*a* to 24*e* projects to the placing surface 31*a* side relative to the nips 51 and 52. Specifically, each of the projections 24*a* to 24*e* projects from an opposite side of the placing surface 31*a* to the placing surface 31*a* side relative to the nips 51 and 52 through the discharge plane 56. Each of the projections 24*a*, 24*b*, 24*d*, and 24*e* has a guide surface 61 opposite to the placing surface 31*a*, and the projection 24*c* has a guide surface 62 opposite to the placing surface 31*a*. Each of the guide surfaces 61 and 62 is located at the placing surface 31*a* side end of the corresponding projection. Although FIG. 3 illustrates the discharge guide 24 as comprising three separate parts, the discharge guide 24 is actually formed integrally.

The projection 24*c* is disposed between the roller portion 22*a* (or the first pair of discharge rollers) and the roller portion 22*b* (or the second pair of discharge rollers) in the Y-axis direction (referred to also as the axial direction) parallel to the axes A1 and A2. The projection 24*a* is disposed on an opposite side of the projection 24*c* with respect to the roller portion 22*a* (or the first pair of discharge rollers) in the Y-axis direction. The projection 24*e* is disposed on an opposite side of the projection 24*c* with respect to the roller portion 22*b* (or the second pair of discharge rollers) in the Y-axis direction. The projection 24*b* is disposed between the projection 24*c* and the roller portion 22*a* (or the first pair of discharge rollers) in the Y-axis direction. The projection 24*d* is disposed between the projection 24*c* and the roller portion 22*b* (or the second pair of discharge rollers) in the Y-axis direction. Specifically, the projections 24*a* to 24*e* are formed plane-symmetrically with respect to a virtual center plane 55 perpendicular to the Y-axis and passing through the center between the nips 51 and 52. In the Y-axis direction, the projections 24*a* to 24*e* are configured as follows: the projection 24*c* is located at the center portion and wider than the other projections 24*a*, 24*b*, 24*d*, and 24*e*; the projections 24*b* and 24*d* are located on the both sides of the projection 24*c* and have the same width narrower than that of the projection 24*c*; the projection 24*a* is located on the outer side of the projection 24*b* across the nip 51; the projection 24*e* is located on the outer side of the projection 24*d* across the nip 52; and the projections 24*a* and 24*e* have the same width narrower than that of the projection 24*c* and wider than those of the projections 24*b* and 24*d*.

The projections 24*a*, 24*b*, 24*d*, and 24*e* have the same shape when viewed from the Y-axis direction. Thus, the shape of the projection 24*a* will now be representatively described with reference to FIG. 4 showing the cross-section of the projection 24*a*.

In FIG. 4, the dashed-dotted line in the direction of arrow F indicates the virtual line 57 perpendicularly intersecting the axis A1 of the first discharge roller 22 and the axis A2 of the second discharge roller 23. The dashed-dotted line in the direction of arrow G indicates the discharge plane 56 perpendicular to the virtual line 57 and passing through the nips 51 and 52. The first discharge roller 22 and the second discharge roller 23 convey and discharge the recording sheet 40 along the discharge plane 56 in the direction of arrow G (i.e., the discharging direction) in the nips 51 and 52. The guide surface 61 extends from an upstream side to a downstream side of the nip 51 in the discharging direction, and includes an inlet surface 61*a* located upstream of the nip 51 and an outlet surface 61*b* located downstream of the nip 51. The guide portion 81 of the main body 80 (see FIG. 2) has a guide surface 33 below the guide surface 61. On the upstream side of and in the vicinity of the nip 51 in the conveying direction, the guide surface 61 and the guide surface 33 in combination form the conveying path. The projection 24*a* receives the recording sheet 40 conveyed from below in a direction indicated by arrow H, and guides the leading edge of the conveyed recording sheet 40 along the conveying path toward the nip 51.

As shown in FIG. 4, when viewed from the Y-axis direction, the inlet surface 61*a* is disposed generally along and slightly below the discharge plane 56 (on the roller portion 22*a* side). The inlet surface 61*a* curves so as to separate from the discharge plane 56 as approaching the nip 51, and projects downward (to the roller portion 22*a* side) from the nip 51 by a predetermined amount on the virtual line 57.

On the downstream side of the nip 51, the guide surface 61 is inclined to the discharge plane 56 so as to approach the discharge plane 56 downstream in the discharging direction, or parallel to the discharge plane 56. In the example of FIG. 4, the outlet surface 61*b* is formed continuously to the inlet surface 61*a*, and extends to slightly approach the discharge plane 56 as separating from the nip 51. The outlet surface 61*b* may be parallel to the discharge plane 56. The angle formed between the outlet surface 61*b* and the discharge plane 56 is preferably 0° to 10°. The same applies to the projections 24*b*, 24*d*, and 24*e*. Thus, each of the projections 24*b*, 24*d*, and 24*e* has the guide surface 61 and a positional relationship between the guide surface 61 and the discharge plane 56, in the same manner as the projection 24*a*.

Next, the shape of the projection 24*c* will be described with reference to FIG. 5 showing the cross-section of the projection 24*c*.

In FIG. 5, the dashed-dotted line in the direction of arrow F indicates the virtual line 57, and the dashed-dotted line in the direction of arrow G indicates the discharge plane 56. The guide surface 62 extends from the upstream side to the downstream side of the nip 52 in the discharging direction, and includes an inlet surface 62*a* located upstream of the nip 52 and an outlet surface 62*b* located downstream of the nip 52. On the upstream side of and in the vicinity of the nip 52 in the conveying direction, the guide surface 62 forms the conveying path with the guide surface 33 disposed below the guide surface 62. The projection 24*c* receives the recording sheet 40 conveyed from below in the direction of arrow H, and guides the leading edge of the conveyed recording sheet 40 along the conveying path toward the nips 51 and 52.

As shown in FIG. 5, when viewed from the Y-axis direction, the inlet surface 62*a* is disposed generally along and slightly below the discharge plane 56 (on the roller portion 22*b* side). The inlet surface 62*a* curves so as to separate from the discharge plane 56 as approaching the nip 52, and projects downward (to the roller portion 22*b* side) from the nip 52 by a predetermined amount on the virtual line 57. That is, in this embodiment, on the upstream side of the nip 52, the inlet surface 62*a* of the guide surface 62 of the projection 24*c* is formed in the same manner as the inlet surface 61*a* of the guide surface 61 of the projection 24*a*.

On the downstream side of the nip 52, the guide surface 62 has an inclined area 62*d* inclined with respect to the discharge plane 56 so as to separate from the discharge plane 56 downstream in the discharging direction. In the example of FIG. 5, the outlet surface 62*b* is formed continuously to the inlet surface 62*a* and has the inclined area 62*d*. The inclined area 62*d* is formed continuously to the inlet surface 62*a* and curves so as to separate from the discharge plane 56 as it extends downstream in the discharging direction. Further, the outlet surface 62*b* has an end area 62*c* formed continuously to the inclined area 62*d* so as to extend parallel to the discharge plane 56. Thus, the outlet surface 62*b* further projects downward (to the roller portion 22*b* side) relative to the position on the virtual line 57.

As shown in FIGS. 4 and 5, a difference between a projecting amount by which the projection 24*c* projects to the placing surface 31*a* side relative to the nip 51 and a projecting amount by which the projection 24*a* projects to the placing surface 31*a* side relative to the nip 51 increases downstream from the nip 51 in the discharging direction. The projecting amount of the projection 24*c* is, for example, defined as a distance from the discharge plane 56 to the guide surface 62 in the direction of the virtual line 57. The projecting amount of the projection 24*a* is, for example, defined as a distance from the discharge plane 56 to the guide surface 61 in the direction of the virtual line 57.

Further, as shown in FIGS. 4 and 5, a first projecting amount by which a downstream end in the discharging direction of the projection 24*c* projects to the placing surface 31*a* side relative to the nip 51 is greater than a second projecting amount by which a downstream end in the discharging direction of the projection 24*a* projects to the placing surface 31*a* side relative to the nip 51. The first projecting amount is, for example, defined as a distance from the discharge plane 56 to a downstream end of the guide surface 62 in the direction of the virtual line 57. The second projecting amount is, for example, defined as a distance from the discharge plane 56 to a downstream end of the guide surface 61 in the direction of the virtual line 57.

Next, a configuration in the vicinity of the nip 52 will be described with reference to FIG. 6 showing a cross-section at the roller facing portion at which the roller portion 22*b* of the first discharge roller 22 and the roller portion 23*b* of the second discharge roller 23 form the nip 52.

In FIG. 6, the dashed-dotted line in the direction of arrow F indicates the virtual line 57, and the dashed-dotted line in the direction of arrow G indicates the discharge plane 56. Referring to FIG. 3, the discharge guide 24 does not exist in the vicinity of the roller facing portion. As shown in FIG. 6, on the upstream side of the nip 52 in the conveying direction, the guide surface 33 forms the conveying path with a guide surface 34 of the guide portion 81 of the main body 80 so as to extend to the vicinity of the nip 52.

The leading edge of the recording sheet 40 conveyed from below in the direction of arrow H is guided by the guide surfaces 33 and 34 along the conveying path, and then becomes free (or unguided) near the nip 52. Meanwhile, as described above, the leading edge of the recording sheet 40 is guided below the discharge plane 56 by the projections 24*a* to 24*e* of the discharge guide 24. Thus, the leading edge of the recording sheet 40 moves in abutment on the lower guide surface 33 or the roller portion 22*b* of the first discharge roller 22 to the nip 52.

A configuration in the vicinity of the nip 51 is the same as that in the vicinity of the nip 52, and the description thereof will be omitted.

An operation of the above described medium discharge device 70 will be described below.

Referring to FIG. 1, the fixing unit 28 performs fixing processing on a recording sheet 40, which is conveyed through a conveying path 21 shown in FIG. 2. Referring to FIGS. 4 and 5, the recording sheet 40 is conveyed in the direction of arrow H, and then the leading edge of the recording sheet 40 abuts on and is guided by the inlet surfaces 61*a* and 62*a* (having the same cross-sectional shape) of the projections 24*a* to 24*e* of the discharge guide 24 toward the nips 51 and 52.

At this time, as shown in FIGS. 4 and 5, when viewed from the Y-axis direction, the recording sheet 40 is maintained generally below the discharge plane 56 (on the first roller 22 side) by the inlet surfaces 61*a* and 62*a* of the projections 24*a* to 24*e*, and guided so as to separate from the discharge plane 56 as approaching the nips 51 and 52, protruding downward (to the first roller 22 side) by a predetermined amount relative to the nips 51 and 52 at the position on the virtual line 57.

FIG. 3 shows a sheet cross-section 40*a* of the recording sheet 40 at the position of the nips 51 and 52 with the dashed line. As shown in FIG. 3, when the recording sheet 40 is nipped in the nips 51 and 52, it protrudes to the first discharge roller 22 side from the discharge plane 56 between the nips 51 and 52 by the projections 24*b*, 24*c*, and 24*d*, on the outer side of the nip 51 by the projection 24*a*, and on the outer side of the nip 52 by the projection 24*e*. Thus, the recording sheet 40 is bent to have a wave-shaped cross-section.

When the recording sheet 40 is conveyed toward the nips 51 and 52 while guided by the inlet surfaces 61*a* and 62*a* of the projections 24*a* to 24*e* and the roller portions 22*a* and 22*b* of the first discharge roller 22, until it reaches the nips 51 and 52, it is freely deformable. Thus, the recording sheet 40 can be bent so that its cross-section 40*a* at the position of the nips 51 and 52 becomes into a wavy shape, without a load due to expansion and contraction of the recording sheet 40.

On the other hand, on the downstream side of the nips 51 and 52, the recording sheet 40 moves while nipped in the nips 51 and 52. Thus, it is undesirable that the projections 24*a*, 24*b*, 24*d*, and 24*e*, which are disposed near the nips 51 and 52, guide the recording sheet 40 to forcibly deform the shape of the sheet cross-section 40*a* at the position of the nips 51 and 52 (e.g., increase the protrusion of the recording sheet 40). If the projections 24*a*, 24*b*, 24*d*, and 24*e* were to guide the recording sheet 40 to forcibly deform the shape of the sheet cross-section 40*a* on the downstream side of and in the vicinity of the nips 51 and 52, the recording sheet 40 would be subjected to excessive stress, which causing wrinkles and flaws on the recording sheet 40.

Thus, regarding the projections 24*a*, 24*b*, 24*d*, and 24*e*, as shown in FIG. 4, the outlet surface 61*b* on the downstream side of the nips 51 and 52 is formed to approach the discharge plane 56 as it extends downstream, or parallel to the discharge plane 56. It is noted that since the outlet surface 61*b* extends downstream continuously to the inlet surface 61*a*, the leading edge of the recording sheet is prevented from, immediately after passing through the nips 51 and 52, suddenly becoming free to contact a member near the discharge rollers 22 and 23 and being damaged.

On the other hand, regarding the projection 24*c*, which is disposed relatively away from the nips 51 and 52 between the projections 24*b* and 24*d* (and also between the nips 51 and 52), as shown in FIG. 5, the outlet surface 62*b* on the downstream side of the nips 51 and 52 is curved to separate from the discharge plane 56 as it extends downstream, pressing the recording sheet 40 to prevent slack of the recording sheet 40 on the downstream side of the nips 51 and 52 and maintain proper tension of the recording sheet 40 uniformly in the left-right direction (the Y-axis direction).

Thus, the recording sheet 40 is discharged from the nips 51 and 52 along the discharge plane 56 obliquely upward in the direction of arrow G (FIG. 2) in a state where the sheet cross-section 40*a* is deformed in a wave shape. This wave shape of the sheet cross-section 40*a* has, as shown in FIG. 3, three concave/convex portions (specifically, one concave portion and two convex portions), which increase the stiffness of the recording sheet 40. Therefore, the recording sheet 40 is discharged and falls onto the discharge tray 31 while maintaining a state where its leading edge is difficult to sag due to its own weight. The term "concave/convex portion" means a portion forming either a concave or a convex.

The discharged recording sheet 40 is received and held on the placing surface 31*a* of the discharge tray 31. The placing surface 31*a* faces upward, and here extends parallel to the discharge plane 56. The guide surfaces 61 and 62 of the discharge guide 24 are disposed generally along the discharge plane 56 to face downward, therefore opposing the placing surface 31*a* vertically (more accurately, in the direction of the virtual line 57).

Figure 8:
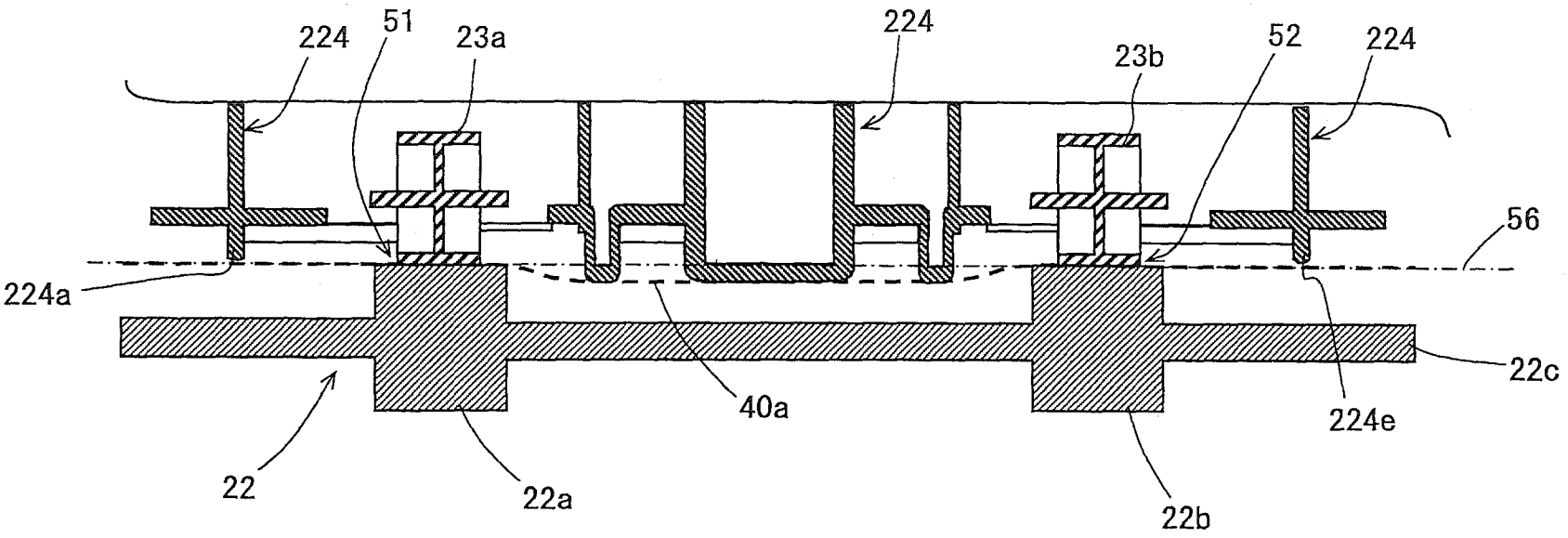
FIG. 8 is a sectional view of a medium discharge device as a comparative example.

FIG. 8 is a sectional view of a medium discharge device as a comparative example, which is the same as the medium discharge device 70 except for having a discharge guide 224 different in shape from the discharge guide 24 in the embodiment.

As shown in FIG. 8, between the nips 51 and 52, the discharge guide 224 presses down the recording sheet 40 below the discharge plane 56 to form a protrusion in the recording sheet 40, similarly to the discharge guide 24 of the embodiment. However, on the outer side of the nip 51 and the outer side of the nip 52, the projections 224*a* and 224*e* do not press the recording sheet 40 down, and form no protrusion in the recording sheet 40. Thus, although the recording sheet 40 is discharged from the nips 51 and 52 along the discharge plane 56 obliquely upward in the direction of arrow G (FIG. 2) in a state where the sheet cross-section 40*a* is deformed in a wave shape in the width direction, the wave shape of the sheet cross-section 40*a* has only one concave/convex portion (specifically, only one concave portion), as shown in FIG. 8.

Thus, in the comparative example, compared to the embodiment, the discharged recording sheet 40 has a low stiffness and is easy to sag during discharging or falling onto the discharge tray 31, and improper discharge, such as page disorder, page missing, and sheet curl, is likely to occur. The stiffness of the recording sheet 40 in the comparative example can be increased by making the protrusion higher or closer to the nips 51 and 52. However, this increases a load on the recording sheet 40 due to deformation, causing flaws or wrinkles on the recording sheet 40.

As described above, the medium discharge device in this embodiment discharges the recording sheet while increasing the stiffness of the recording sheet by deforming the recording sheet in a wave surface shape to form multiple concave/convex portions, thereby reducing improper discharge (or improper stacking), such as page disorder, page missing, and sheet curl, even if the distance by which the recording sheet falls down to the placing surface is large. Further, the medium discharge device in this embodiment can reduce the occurrence of flaws, wrinkles, or the like caused by making the protrusion higher or wider.

Although in this embodiment, the projection 24*b* is disposed between the projection 24*c* and the nip 51 and the projection 24*d* is disposed between the projection 24*c* and the nip 52, either or both of the projections 24*b* and 24*d* may be omitted. Even in such a case, three concave/convex portions are formed in the wave surface of the discharged recording sheet, and advantages similar to those described above can be obtained. In this case, it is desirable to set the width of the projection 24*c* or the shape of the outlet surface 62*b* of the projection 24*c* so as to reduce the slack of the recording sheet 40 on the downstream side of the nips 51 and 52.

Further, although in this embodiment, the projection 24*a* is disposed on the end side of the nip 51 and the projection 24*e* is disposed on the end side of the nip 52, either the projection 24*a* or 24*e* may be omitted. Even in such a case, compared to the comparative example, the number of concave/convex portions in the wave surface of the discharged recording sheet increases, and the stiffness of the discharged recording sheet is strengthened.

Second Embodiment

An image forming apparatus in the second embodiment will be described below. This image forming apparatus is substantially the same as in the first embodiment, except for including a medium discharge device different from that in the first embodiment. Thus, descriptions of parts that are the same as in the first embodiment will be omitted or simplified in the description below, and the same reference characters will be used.

Figure 7:
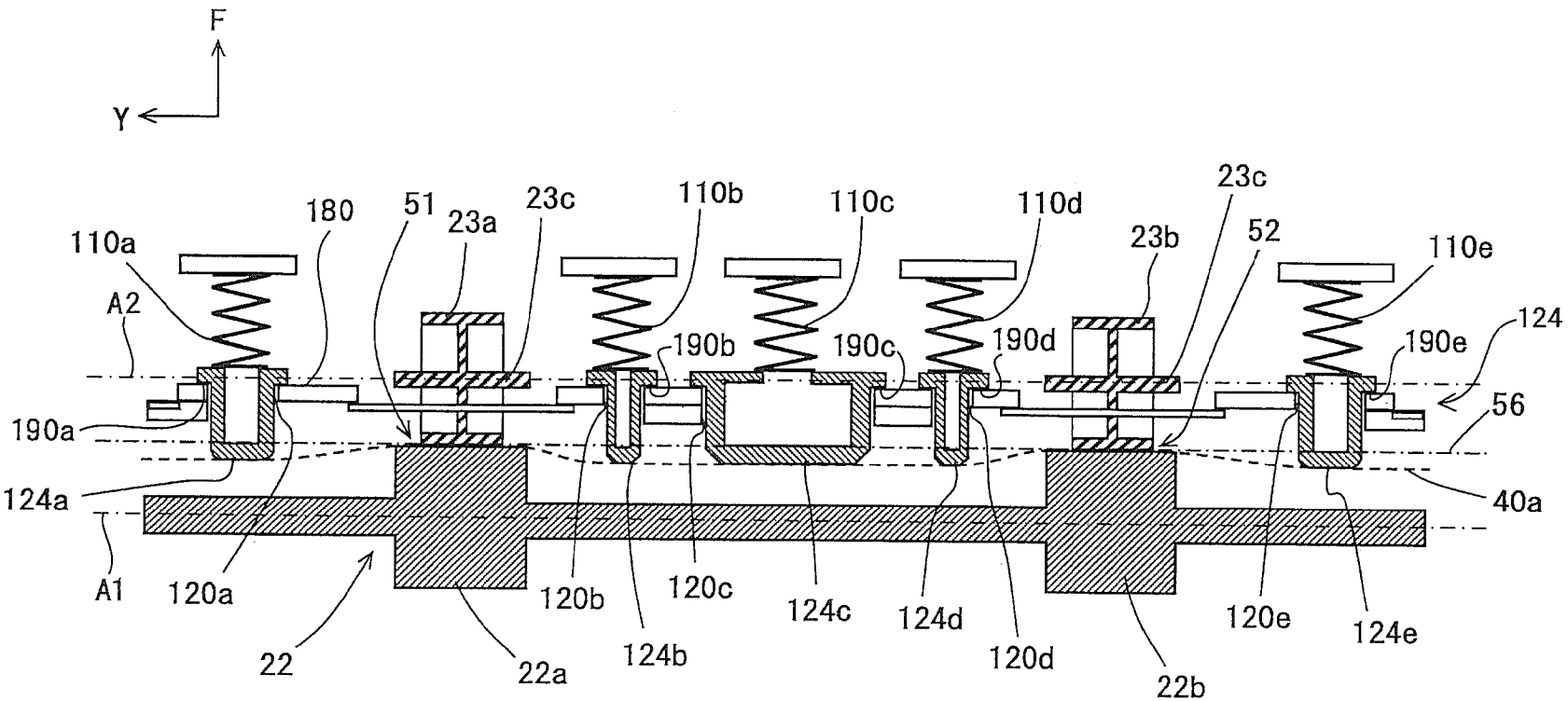
FIG. 7 is a main part sectional view of a medium discharge device in a second embodiment of the invention.

FIG. 7 is a main part sectional view of the medium discharge device in the second embodiment. FIG. 7 corresponds to the sectional view along line A-A in FIG. 2, similarly to FIG. 3 in the first embodiment.

The medium discharge device in the second embodiment includes a discharge guide 124 corresponding to the discharge guide 24 in the first embodiment. The discharge guide 124 includes guide projections 124*a* to 124*e* corresponding to the projections 24*a* to 24*e* in the first embodiment. The guide projections 124*a* to 124*e* are disposed slidably in a direction perpendicular to the discharge plane 56, and urged toward the placing surface 31*a*. The guide projections 124*a* to 124*e* are disposed separately from each other, and individually urged by respective coil springs 110*a* to 110*e* as urging members.

As shown in FIG. 7, the image forming apparatus includes guide holding holes 120*a* to 120*e* formed in a main body 180 of the image forming apparatus. The guide projections 124*a* to 124*e* are inserted and held in the guide holding holes 120*a* to 120*e* slidably in the direction of the virtual line 57, respectively. The guide projections 124*a* to 124*e* have restricting portions (or flange portions) 190*a* to 190*e*, respectively. The restricting portions 190*a* to 190*e* abut on the main body 180 at parts around the guide holding holes 120*a* to 120*e*, thereby restricting the guide projections 124*a* to 124*e* from moving in a projecting direction opposite to arrow F from their normal positions, respectively. When the guide projections 124*a* to 124*e* are in their normal positions, they are pressed against the main body 180 by the coil springs 110*a* to 110*e* in the projecting direction.

Each of the guide projections 124*a*, 124*b*, 124*d*, and 124*e* is configured to have, in its normal position, a guide surface identical to the guide surface 61 of the projection 24*a* in FIG. 4, and a relationship between the guide surface and the nips 51 and 52 identical to the relationship between the guide surface 61 and the nips 51 and 52 in FIG. 4.

The guide projection 124*c* is configured to have, in its normal position, a guide surface identical to the guide surface 62 of the projection 24*c* in FIG. 5, and a relationship between the guide surface and the nips 51 and 52 identical to the relationship between the guide surface 62 and the nips 51 and 52 in FIG. 5.

Therefore, when the guide projections 124*a* to 124*e* are in their normal positions, the recording sheet 40 is discharged through the nips 51 and 52 along the discharge plane 56 obliquely upward in the direction of arrow G (FIG. 2) in a state where the sheet cross-section 40*a* is deformed in a wave shape, in the same manner as the first embodiment.

In this embodiment, the guide projections 124*a* to 124*e* are slidably urged by the respective coil springs 110*a* to 110*e*. Thus, when the recording sheet 40 is discharged, depending on the stiffness of the recording sheet 40 itself, each of the guide projections 124*a* to 124*e* moves in a retreating direction opposite to the projecting direction to vary its height from the discharge plane 56 in the projecting direction, thereby adjusting a degree of increase of the stiffness. Specifically, the height of the guide projection 124*a* is at its maximum when the guide projection 124*a* is in its normal position, and decreases as the guide projection 124*a* moving in the retreating direction from its normal position. The normal position is also referred to as the maximum height position. The same is true for the other guide projections 124*b* to 124*e*. When the guide projections 124*a* to 124*e* are in their normal positions, they bend the recording sheet 40 maximally. That is, when the recording sheet 40 is guided by the guide projections 124*a* to 124*e* in their normal positions, the recording sheet 40 is discharged in a maximum bending state where it is maximally bent.

More specifically, when the recording sheet is a thin paper sheet with low stiffness, since its leading edge is easy to sag during discharge, its stiffness needs to be increased. When the recording sheet with low stiffness is discharged, since the coil springs 110*a* to 110*e* do not deform and the guide projections 124*a* to 124*e* stay in their normal positions (maximum height positions), the recording sheet is discharged in a state where it is maximally bent and its stiffness is maximally increased. In this case, although the recording sheet is maximally bent, since the stiffness of the recording sheet itself is low, flaws and wrinkles are difficult to occur.

On the other hand, when the recording sheet is a thick paper sheet with high stiffness, since its leading edge is difficult to sag during discharge, its stiffness does not need to be increased much. When the recording sheet with high stiffness is discharged, the recording sheet presses the guide projections 124*a* to 124*e* down in the retreating direction from their normal positions (maximum height positions) against the urging force of the coil springs 110*a* to 110*e*, lowering the heights of the guide projections 124*a* to 124*e*. Therefore, the recording sheet is discharged in a state where it is less bent. If the recording sheet with high stiffness were to be forcibly bent, flaws and wrinkles would occur. The configuration of this embodiment can prevent such problems.

Although in this embodiment, the guide projections 124*a* to 124*e* are formed separately from each other and individually urged by the coil springs, the guide projections 124*a* to 124*e* may be formed integrally, and the whole of the guide projections 124*a* to 124*e* may be urged by only one coil spring or urging member, for example.

As described above, the medium discharge device in this embodiment adjusts the amount of bending of the recording sheet depending on the stiffness of the recording sheet so that the higher the stiffness, the smaller the amount of bending, and prevents a recording sheet with high stiffness (e.g., a thick paper sheet) from being bent more than necessary. Thus, this embodiment can provide the same advantages as in the first embodiment without causing flaws and wrinkles on the recording sheet.

In this specification, the term "parallel" is intended to include not only completely parallel but also substantially parallel, and the term "perpendicular" is intended to include not only completely perpendicular but also substantially perpendicular.

While the preferred embodiments of the present invention have been illustrated in detail, it should be apparent that modifications and improvements may be made to the invention without departing from the spirit and scope of the invention as described in the following claims.

For example, although in the above embodiments, the LED head is used as an exposure unit of the image forming apparatus, a laser exposure unit including a small-sized laser and a polygon mirror may be used. Further, although the above embodiments illustrate an image forming apparatus using a direct transfer system, the invention is applicable to an image forming apparatus using an intermediate transfer belt. Furthermore, the above embodiments exemplify a printer as an image forming apparatus, but the invention is applicable to a copier, a facsimile machine, or other image forming apparatus.

What is claimed is:

1. A medium discharge device comprising:

a discharge tray having a placing surface on which a medium is to be placed;

a first pair of discharge rollers configured to form a first nip between the first pair of discharge rollers, and rotate about respective axes parallel to each other to discharge the medium through the first nip in a discharging direction onto the discharge tray;

a second pair of discharge rollers configured to form a second nip between the second pair of discharge rollers, and rotate about the respective axes to discharge the medium through the second nip in the discharging direction onto the discharge tray; and a discharge guide for guiding the medium discharged by the first pair of discharge rollers and the second pair of discharge rollers, the discharge guide including:

a first projection disposed between the first pair of discharge rollers and the second pair of discharge rollers in an axial direction parallel to the axes, the first projection projecting toward the placing surface relative to the first and second nips and having a first guide surface; and a second projection disposed on an opposite side of the first projection with respect to the first pair of discharge rollers in the axial direction, the second projection projecting toward the placing surface relative to the first and second nips and having a second guide surface;

wherein each of the first and second guide surfaces extends from an upstream side to a downstream side of the first and second nips in the discharging direction; and wherein on the downstream side of the first and second nips, the first guide surface has an area inclined to a discharge plane passing through the first and second nips and being perpendicular to a virtual line perpendicularly intersecting the axes so as to separate from the discharge plane downstream in the discharging direction;

wherein on the downstream side of the first and second nips, the second guide surface is parallel to the discharge plane, or is inclined to the discharge plane so as to approach the discharge plane downstream in the discharging direction.

2. The medium discharge device of claim 1, wherein a difference between a projecting amount by which the first projection projects toward the placing surface relative to the first nip and a projecting amount by which the second projection projects toward the placing surface relative to the first nip increases downstream from the first nip in the discharging direction.

3. The medium discharge device of claim 1, wherein a first projecting amount by which a downstream end in the discharging direction of the first projection projects toward the placing surface relative to the first nip is greater than a second projecting amount by which a downstream end in the discharging direction of the second projection projects toward the placing surface relative to the first nip.

4. The medium discharge device of claim 1, wherein the discharge guide further includes a third projection disposed on an opposite side of the first projection with respect to the second pair of discharge rollers in the axial direction, the third projection projecting toward the placing surface relative to the first and second nips and having a third guide surface.

5. The medium discharge device of claim 4, wherein the discharge guide further includes:

a fourth projection disposed between the first projection and the first pair of discharge rollers in the axial direction, the fourth projection projecting toward the placing surface relative to the first and second nips and having a fourth guide surface; and a fifth projection disposed between the first projection and the second pair of discharge rollers in the axial direction, the fifth projection projecting toward the placing surface relative to the first and second nips and having a fifth guide surface.

6. The medium discharge device of claim 5, wherein each of the third to fifth guide surfaces extends from an upstream side to a downstream side of the first and second nips in the discharging direction.

7. The medium discharge device of claim 6, wherein on the downstream side of the first and second nips, each of the third to fifth guide surfaces is parallel to the discharge plane, or is inclined to the discharge plane so as to approach the discharge plane downstream in the discharging direction.

8. An image forming apparatus comprising the medium discharge device of claim 1.

9. A medium discharge device comprising:

a discharge tray having a placing surface on which a medium is to be placed;

a first pair of discharge rollers configured to form a first nip between the first pair of discharge rollers, and rotate about respective axes parallel to each other to discharge the medium through the first nip in a discharging direction onto the discharge tray;

a second pair of discharge rollers configured to form a second nip between the second pair of discharge rollers, and rotate about the respective axes to discharge the medium through the second nip in the discharging direction onto the discharge tray; and a discharge guide for guiding the medium discharged by the first pair of discharge rollers and the second pair of discharge rollers, the discharge guide including;

a first projection disposed between the first pair of discharge rollers and the second pair of discharge rollers in an axial direction parallel to the axes, the first projection projecting toward the placing surface relative to the first and second nips and having a first guide surface; and a second projection disposed on an opposite side of the first projection with respect to the first pair of discharge rollers in the axial direction, the second projection projecting toward the placing surface relative to the first and second nips and having a second guide surface;

wherein the first and second projections are disposed slidably in a direction in which a virtual line perpendicularly intersecting the axes extends, and urged toward the placing surface.

10. The medium discharge device of claim 9, wherein the first and second projections are formed separately from each other and individually urged.

11. The medium discharge device of claim 9, wherein each of the first and second guide surfaces extends from an upstream side to a downstream side of the first and second nips in the discharging direction.

12. The medium discharge device of claim 11, wherein on the downstream side of the first and second nips, the second guide surface is parallel to a discharge plane passing through the first and second nips and being perpendicular to the virtual line, or is inclined to the discharge plane so as to approach the discharge plane downstream in the discharging direction.

13. The medium discharge device of claim 11, wherein on the downstream side of the first and second nips, the first guide surface has an area inclined to a discharge plane passing through the first and second nips and being perpendicular to the virtual line so as to separate from the discharge plane downstream in the discharging direction.

14. An image forming apparatus comprising the medium discharge device of claim 9.

15. A medium discharge device comprising:

a discharge tray having a placing surface on which a medium is to be placed;

a first pair of discharge rollers including a first roller that rotates about a first axis extending in a first direction and a second roller that rotates about a second axis extending in the first direction, the first roller and the second roller forming a first nip between the first roller and the second roller, the first pair of discharge rollers discharging the medium through the first nip onto the discharge tray;

a second pair of discharge rollers including a third roller that rotates about the first axis and a fourth roller that rotates about the second axis, the third roller and the fourth roller forming a second nip between the third roller and the fourth roller, the second pair of discharge rollers discharging the medium through the second nip onto the discharge tray; and a discharge guide configured to guide the medium discharged by the first pair of discharge rollers and the second pair of discharge rollers, the discharge guide including a plurality of projections including at least a first projection and a second projection;

wherein the first projection is disposed between the first pair of discharge rollers and the second pair of discharge rollers in the first direction, projects in a second direction in which a virtual line perpendicularly intersecting both the first axis and the second axis extends toward the placing surface, and has a first guide surface;

wherein of the plurality of projections, the second projection is located farthest from a center of the discharge guide on an opposite side of the first projection with respect to the first pair of discharge rollers in the first direction, projects in the second direction, and has a second guide surface;

wherein in a plane parallel to and including both the first axis and the second axis, a distance between the first guide surface and the placing surface is smaller than a distance between the first nip and the placing surface, and a distance between the second guide surface and the placing surface is smaller than a distance between the first nip and the placing surface;

wherein each of the first and second guide surfaces extends from an upstream side to a downstream side of the first nip in a discharging direction in which the medium is discharged; and wherein on the downstream side of the first nip, the first guide surface has an area inclined to a discharge plane passing through the first nip and being perpendicular to the virtual line so as to separate from the discharge plane downstream in the discharging direction; and wherein on the downstream side of the first nip, the second guide surface is parallel to a discharge plane passing through the first nip and being perpendicular to the virtual line, or is inclined to the discharge plane so as to approach the discharge plane downstream in the discharging direction.

16. An image forming apparatus comprising the medium discharge device of claim 15.

17. A medium discharge device comprising:

a discharge tray having a placing surface on which a medium is to be placed;

a pair of discharge rollers including a first roller that rotates about a first axis extending in a first direction and a second roller that rotates about a second axis extending in the first direction, the first roller and the second roller forming a nip between the first roller and the second roller, the pair of discharge rollers discharging the medium through the nip onto the discharge tray; and a discharge guide configured to guide the medium discharged by the pair of discharge rollers, the discharge guide including:

a first projection that projects in a second direction in which a virtual line perpendicularly intersecting both the first axis and the second axis extends toward the placing surface, and has a first guide surface; and a second projection that projects in the second direction, and has a second guide surface;

wherein in a plane parallel to and including both the first axis and the second axis, a distance between the first guide surface and the placing surface is smaller than a distance between the nip and the placing surface, and a distance between the second guide surface and the placing surface is smaller than a distance between the nip and the placing surface; and wherein in the first direction, a length of the first guide surface is greater than a length of the second guide surface.

18. The medium discharge device of claim 17, wherein the pair of discharging rollers is disposed between the first projection and the second projection in the first direction; and wherein each of the first and second guide surfaces extends from an upstream side to a downstream side of the nip in a discharging direction in which the medium is discharged.

19. The medium discharge device of claim 18, wherein on the downstream side of the nip, the second guide surface is parallel to a discharge plane passing through the nip and being perpendicular to the virtual line, or is inclined to the discharge plane so as to approach the discharge plane downstream in the discharging direction.

20. The medium discharge device of claim 18, wherein on the downstream side of the nip, the first guide surface has an area inclined to a discharge plane passing through the nip and being perpendicular to the virtual line so as to separate from the discharge plane downstream in the discharging direction.

21. An image forming apparatus comprising the medium discharge device of claim 17.

* * * * *